US005150701A

United States Patent [19]

Wackrow et al.

[11] Patent Number: 5,150,701

[45] Date of Patent: Sep. 29, 1992

[54] AIR GUN WITH ROTARY MAGAZINE

[75] Inventors: Roger D. Wackrow, Redditch; Kenneth W. White, Solihull; Harold C. Jones, Studley, all of England

[73] Assignee: B.S.A. Guns (UK) Limited, Great Britain

[21] Appl. No.: 695,211

[22] Filed: May 3, 1991

[30] Foreign Application Priority Data

May 5, 1990 [GB] United Kingdom ..... 9010201
Sep. 17, 1990 [GB] United Kingdom ..... 9020238

[51] Int. Cl.[5] ..... F41B 11/00

[52] U.S. Cl. ..... 124/67; 124/48; 124/52

[58] Field of Search ..... 124/48, 66, 67, 51.1, 124/53, 65

[56] References Cited

U.S. PATENT DOCUMENTS

| | | | |
|---|---|---|---|
| 2,962,017 | 11/1960 | Horowitz et al. | 124/48 X |
| 3,612,026 | 10/1971 | Vadas et al. . | |
| 3,665,631 | 5/1972 | Domian et al. . | |
| 3,741,189 | 6/1973 | Kester et al. | 124/48 X |
| 3,782,359 | 1/1974 | Kester et al. | 124/48 |
| 4,422,433 | 12/1983 | Milliman | 124/48 X |
| 4,819,609 | 4/1989 | Tippmann | 124/48 X |
| 4,850,328 | 7/1989 | Sindel . | |
| 4,986,251 | 1/1991 | Lilley | 124/48 X |
| 4,993,400 | 2/1991 | Fitzwater | 124/48 |

FOREIGN PATENT DOCUMENTS

| | | |
|---|---|---|
| 0341090 | 11/1989 | European Pat. Off. . |
| 3728080 | 3/1989 | Fed. Rep. of Germany . |
| 598669 | 2/1948 | United Kingdom . |
| 685700 | 1/1953 | United Kingdom . |
| 302279 | 1/1980 | United Kingdom . |
| 2179429 A | 3/1987 | United Kingdom . |
| 2218916 A | 11/1989 | United Kingdom . |

*Primary Examiner*—Peter M. Cuomo
*Attorney, Agent, or Firm*—Leydig, Voit & Mayer

[57] ABSTRACT

The body 12 of an air gun accommodates a removable magazine 16 immediately behind the breech 14, for pellets to be loaded one at a time from the magazine into the breech. The magazine comprises a drum 33 which is rotatably mounted within a housing 31 and comprises ten pellet-holding slots 38 around its axis. A torsion spring 42 urges rotation of the drum in indexing steps as controlled by an escapement mechanism comprising a rocking pawl 50. The pawl is displaced against the action of a return spring 58 by a plunger 60 which projects from a cocking arm 22 of a conventional cocking mechanism of the gun; the plunger is arranged to actuate the escapement only towards the end of a cocking stroke of the arm 22. A loading ram/air transfer tube 28 is reciprocated, in effecting the cocking action, to withdraw from one slot 38 in the drum and enter a next slot to load a fresh pellet into the breech.

6 Claims, 2 Drawing Sheets

AIR GUN WITH ROTARY MAGAZINE

It is known to provide air guns with magazines for holding a plurality of pellets to give the guns a multi-shot capability, avoiding the need for manual insertion of a pellet into the breech for each shot.

One such known arrangement, as described in patent document GB-A-2 152 646, comprises a magazine of a rotary kind in which pellets are retained in a plurality of axially-extending through-slots distributed in a circular array around the axis of a rotatable drum, the drum being arranged to be indexed manually or automatically between shots to bring a next pellet into axial alignment with the barrel bore for insertion into the breech. The magazine, which is removable from the gun for recharging with pellets, is accommodated in a slot in the body of the gun behind the breech.

In that known arrangement, feeding of a pellet from the drum into the breech is effected by means of a loading ram provided by a manually reciprocable bolt. The ram is driven through each of the slots in the drum in turn, to drive a pellet from the drum and locate it positively in the breech before a next shot. The action of the ram in driving the pellet into the breech may usefully serve also to size the pellet, correcting slight deformities in the pellet. The loading ram doubles as a transfer tube for transmitting pellet-impelling compressed air to the breech.

In a further developed form of that loading action, in a piston-type gun which was promoted in the UK by B.S.A. Guns as the VS 2000 gun in 1986, the loading ram/transfer tube is fixed to a forward end of an outer cylinder which houses the air-expelling piston, the tube extending forwards from an outlet port in an end wall of the outer cylinder to transmit air from the cylinder to the breech when the piston is driven forwards in firing the gun. To effect axial reciprocation of the transfer tube (as required to withdraw the tube from the drum to permit an indexing rotation of the drum, and to reinsert the tube into a next slot in the drum to advance a next pellet into the breech) the outer cylinder is arranged to be drawn back in retracting the piston to cock the gun, the cylinder being moved fully forwards again in a return stroke of the cocking action.

It is mentioned in GB-A-2 152 646 that the drum may be indexed automatically. In designing such a system there are two particular aspects to be borne in mind. First, the use of the pellets themselves to stop rotation of the drum at each indexing step should be avoided, since lateral impacts could result in distortion of soft lead pellets. Secondly, the system should not too readily permit two (or more) pellets to be inserted accidentally together into the breech. Whilst it would ordinarily still be possible to discharge at least two pellets through the barrel in the ordinary way, it is plainly undesirable that such a situation should arise.

It is an object of the present invention to provide an improved air gun having an automatically advanced rotary magazine facility.

The invention provides, in one of its aspects, an air gun comprising a rotary magazine arranged to hold a plurality of pellets for loading one at a time into a breech of the gun, the magazine comprising a rotatably mounted drum having a plurality of pellet-holding slots distributed around the rotational axis of the drum and indexing means arranged to cause rotation of the drum in indexing steps to bring the slots successively into alignment with the breech for insertion of pellets into the breech, the gun comprising a reciprocable loading ram which can be driven into and through the slots in the drum in turn to drive the pellets from the drum and into the breech and the indexing means comprising drum-rotating means for urging rotation of the drum and an escapement mechanism which can be operated after each withdrawal of the loading ram from the drum to permit an indexing rotation of the drum.

The escapement mechanism can be arranged to be operated automatically in connection with operation of a cocking mechanism of the gun. To minimise risk of inserting two pellets into the breech by accident, the arrangement is preferably such that the escapement mechanism does not become actuated to permit indexing of the drum until at least a substantial part of the action to cock the gun has been completed. In that way, it can be arranged that an operator should feel through the cocking mechanism that the gun is already cocked (and so the drum already indexed) well before reaching the stage in operating the cocking mechanism when the escapement mechanism will again be actuated. Most preferably the cocking action is arranged to be completed (i.e. the gun becomes fully cocked) not later than the stage in operation of the cocking mechanism at which the escapement mechanism is actuated.

Actuation of the escapement mechanism from the cocking mechanism may be by a suitable mechanical connection (e.g. an operating plunger projecting from a sidelever, or underlever, cocking arm) or might, for example, utilise the closing of electrical contacts by a cocking arm to cause operation of a solenoid-operated device.

In a preferred construction, the escapement mechanism comprises a rocking pawl which in each complete oscillation permits rotation of the magazine by one indexing step. The pawl may be spring-biased in one direction of pivotal movement and arranged to be deflected against the action of the spring by the escapement-actuating means, the actuating means then being withdrawn to permit completion of an oscillation by return of the pawl under the action of the spring. Instead of spring-biasing the pawl, it may be caused to move in the return direction by a camming action from the drum acting against a cam face of the pawl.

In another of its aspects the invention provides a rotary magazine for use in an air gun according to the last preceding paragraph but three, the magazine comprising a rotatably mounted drum having a plurality of pellet-holding slots distributed around the rotational axis of the drum and indexing means arranged to cause rotation of the drum in indexing steps to bring the slots successively into a breech-loading position in the magazine, the indexing means comprising drum-rotating means for urging rotation of the drum and an escapement mechanism which can be operated to regulate indexing rotations of the drum.

A magazine as set out in the last preceding paragraph may be constructed arranged and adapted to operate in accordance with any of the features and operational aspects referred to in the last preceding paragraphs but one, two and three.

There now follows a detailed description, to be read with reference to the accompanying drawings, of an air gun which illustrates the invention by way of example.

Figure 1:
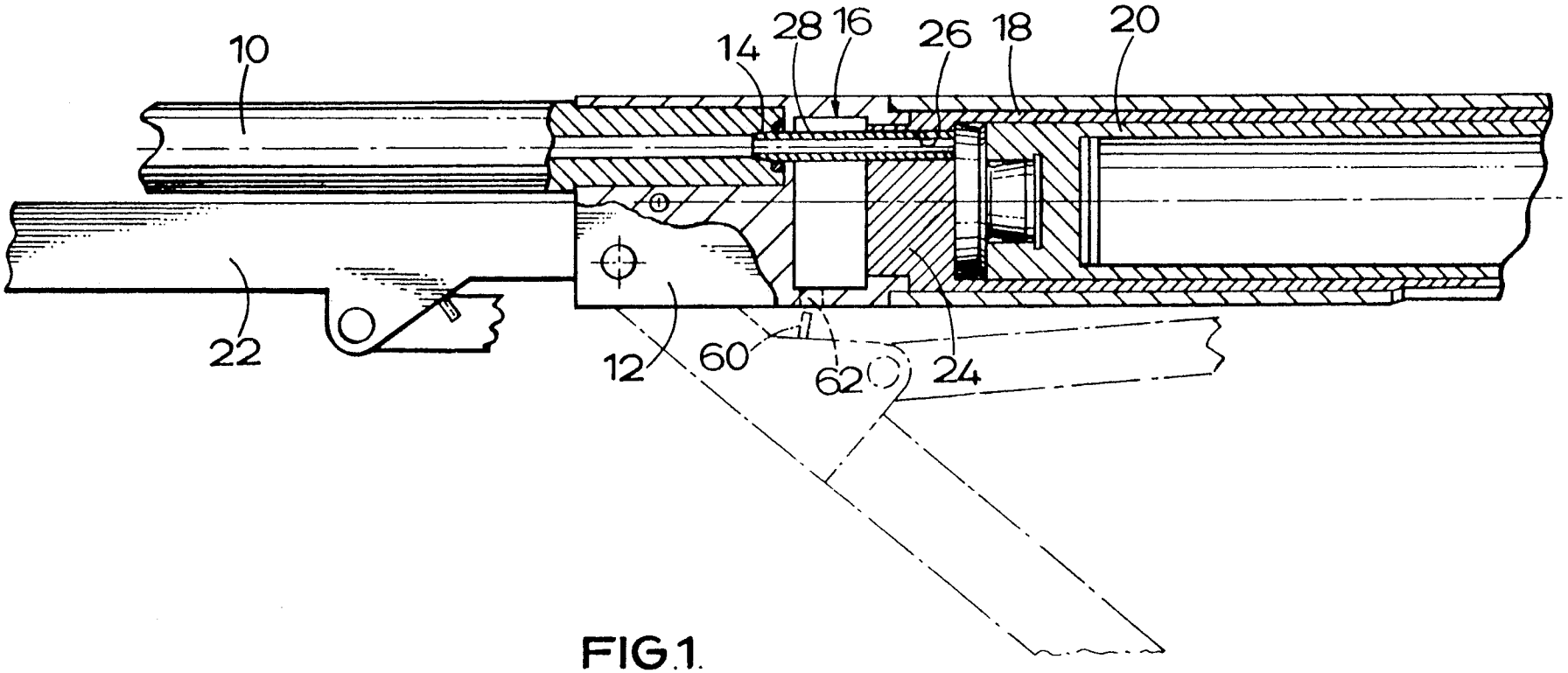
FIG. 1 is a diagrammatic longitudinal sectional view of a breech region of an air rifle.

A piston-type air rifle, of a broadly known kind, comprises (as shown in FIG. 1) a barrel 10 extending from a body 12 of the gun. Immediately behind a bore entry 14 of the barrel (hereinafter referred to as the breech 14) there is a transverse slot in the body which accommodates a removable magazine 16 located in the slot. Immediately behind the magazine the body 12 houses a tubular outer cylinder 18, which itself houses a spring-backed piston 20, the outer cylinder 18 being axially slidable within the body 12 and the piston 20 being axially slidable within the outer cylinder 18. An under-lever-type cocking arm 22, pivoted at a position adjacent to the forward end of the body, enables the outer cylinder 18 and piston 20 to be drawn back together within the body 12 to cock the gun in a conventional manner, the outer cylinder 18 alone returning to its forward position adjacent to the magazine upon returning the cocking arm up to the barrel. The gun is shown in FIG. 1 in its uncocked condition, except that the position of the cocking arm is also shown in broken line as it would be towards the end of a cocking stroke.

The outer cylinder 18 comprises a forward end wall 24 through which an air transfer port 26 is provided. A straight, axially extending, transfer tube 28 is fixed to the end wall 24 to extend forwards from the port 26 through the magazine 16, to transmit air from within the outer cylinder 18 to behind a pellet in the breech 14 in firing the gun. The transfer tube 28 serves also as a loading ram for feeding pellets from the magazine 16 to the breech, as will be described in more detail hereinafter.

Figure 2:
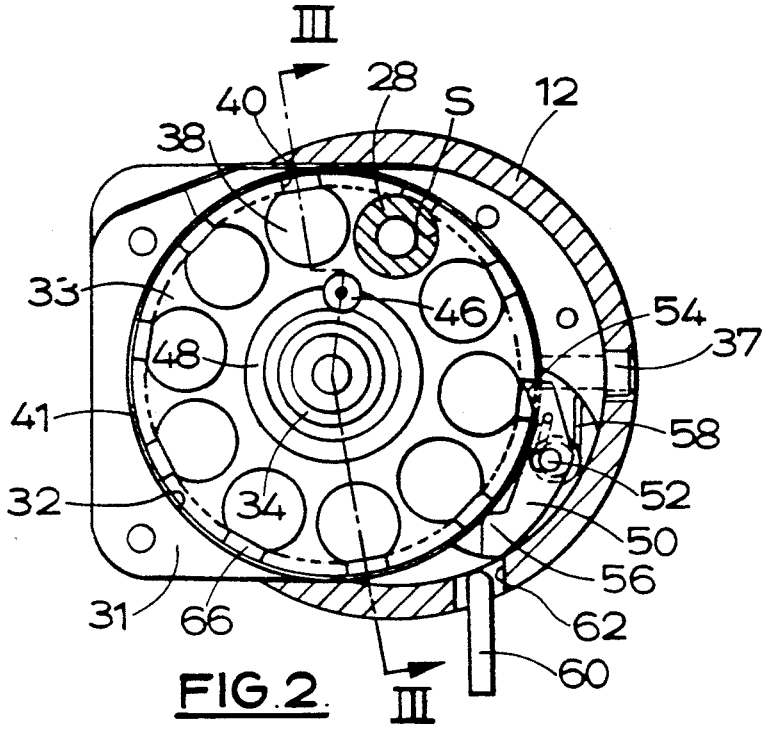
FIG. 2 is a forwards view, partly in transverse cross-section through a body of the gun, showing a magazine.
Figure 3:
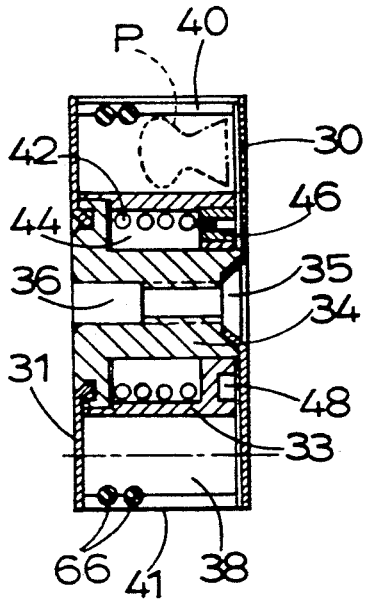
FIG. 3 is a view in cross-section through the magazine on line III—III of FIG. 2.
Figure 4:
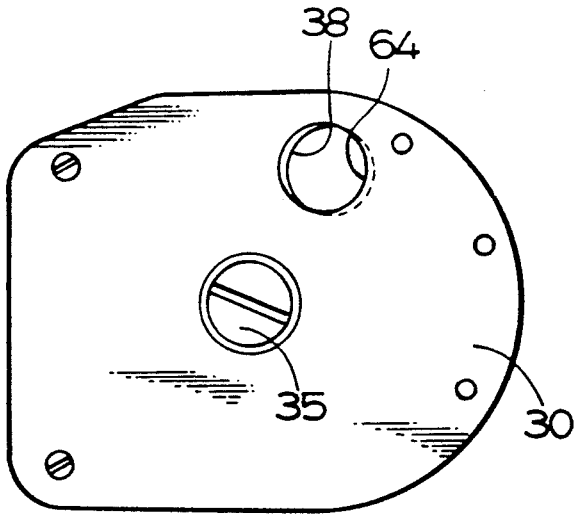
FIG. 4 is a rear view of the magazine taken out of the gun.

The magazine is shown in FIGS. 2, 3 and 4, a rear cover plate 30 of the magazine being omitted from FIG. 2 for purposes of illustration. The magazine comprises a housing 31 which forms a cylindrical recess 32 in which a pellet-holding drum 33 is rotatably mounted. The drum 33 is annular and mounted for rotation on a tubular central spigot 34 of the housing 31. The rear cover plate 30 is secured centrally to the spigot 34 by a screw 35 entering a rear end of a bore within the spigot, leaving the drum 33 free to rotate about the spigot within the housing.

The inserted magazine is located radially within the body 12 by means of a forwardly-withdrawable centring spindle (not shown) which extends rearwardly through the body from a grip head to engage in a front end portion 36 of the bore. Rotational orientation of the magazine is ensured by means of a radially-directed locating pin 37 which projects inwards from the body 12 and engages in an aperture in the housing 31 (FIG. 2).

The drum 33 provides ten pellet-holding cylindrical slots 38 which are uniformly disposed in a circular array about the rotational axis of the drum. There is a slit 40 extending radially through the drum from each slot 38 to the cylindrical outer peripheral surface 41 of the drum. The slots 38 are sufficiently long to accommodate a pellet P (indicated in broken line) comfortably, the slot diameter being slightly greater than the maximum pellet diameter so that the pellet can slide easily along the slot.

The magazine comprises indexing means arranged to cause rotation of the drum in indexing steps to bring the slots 38 successively into a breech-loading position in the magazine. In FIG. 2 the slot S is in the breech-loading position, being positioned opposite the breech 14 and being held by the transfer tube 28 in axial alignment with the barrel bore. The indexing means comprises drum-rotating means for urging rotation of the drum and an escapement mechanism which can be operated to regulate the indexing rotations of the drum.

The drum-rotating means comprises a drive spring 42 acting between the drum 33 and the housing 31, the spring becoming tensioned in the course of loading the drum with pellets. The spring is a torsion spring housed in an annular chamber 44 between the spigot 34 and the drum 33, one end of the spring being secured to the drum by insertion of an ear into a tubular plug 46 on the drum, and the other end being secured to the housing 31 by insertion of an ear into an aperture in the spigot 34. The plug 46 extends in an axial direction through a rear end wall of the drum 33, interrupting a circular channel 48 in a rear end face of the drum which faces the rear cover plate 30. A tag (not shown) projecting from an inner surface of the cover plate engages in the channel, the plug 46 so limiting rotation of the drum by engagement with the tag, and preventing rotation beyond the tenth shot position.

The escapement mechanism (FIG. 2) comprises a pawl 50 which is pivotally mounted on a pin 52 on the housing 31 adjacent to the periphery of the drum 33. The pawl comprises first and second drum-arresting teeth 54 and 56, located at its opposite ends, which can enter the slits 40 in the periphery of the drum to arrest rotation of the drum. The drive spring 42, when tensioned, urges the drum to rotate (clockwise as viewed in FIG. 2) and the drum is ordinarily arrested by engagement of the first tooth 54 of the pawl in an adjacent slit 40. A pawl-returning torsion spring 58 acts between the pawl and the housing to rotate the pawl anti-clockwise and maintain it in this condition.

Escapement-actuating means comprises a plunger 60 which projects laterally from the cocking arm 22, as shown in FIG. 1. An opening 62 in the body 12 of the gun permits the plunger to be driven in to engage the pawl at the opposite end from the first tooth 54, so to cause rotation of the pawl clockwise and consequent disengagement of the first tooth 54 from the drum. Simultaneously with the action of withdrawing the first tooth 54 from the drum slit 40 in which it resides, the second tooth 56 is caused by the movement of the pawl to enter an adjacent slit 40; the arrangement permits the drum to rotate slightly, upon disengagement of the first tooth, until arrested by the second tooth 56 in the adjacent slit. Upon the plunger 60 being withdrawn, the torsion spring 58 causes the pawl to pivot back again (anti-clockwise) to disengage the second tooth 56 from the drum slit in which it is residing. There is then a stage in which neither tooth is in engagement with a slit 40, the first tooth 54 sliding over the peripheral surface 41 of the drum whilst the drum rotates under the action of the drive spring 42 until the first tooth 54 drops into a next slit 40 to arrest its rotation. A next successive pellet-holding slot 38 in the drum will now have been brought into the breech-loading position.

Operation of the transfer tube 28 as a loading ram will now be explained. The gun is fired with the outer cylinder 18 in the forward position shown in FIG. 1, and so with the tube 28 extending through one of the slots 38 in the magazine drum. Aligned apertures 64 (see FIG. 4) in the housing 31 and the rear cover plate 30 permit the tube to extend right through the magazine. The cocking arm is then swung rearwards to cock the gun, the outer cylinder 18 being moved rearwards in that action, away from the breech 14, as hereinbefore referred to. The transfer tube 28 so becomes withdrawn from the magazine, and it is only subsequently in the swing of the cocking arm at the end of the cocking stroke that the plunger 60 becomes inserted to actuate the escapement mechanism. Upon returning the cocking arm forwards, the magazine drum having now been indexed to bring a next pellet-holding slot 38 into the breech-loading position, the transfer tube 28 is brought forwards on the outer cylinder 18 and inserted through that next slot in the magazine. In passing through the slot, the tube pushes a pellet in that slot forwards through the slot and into the breech 14. In so acting as a loading ram, the tube 28 may serve also to size the pellet and correct minor deformities. The gun is then ready to be fired again.

It is to be noted that in effecting the cocking stroke of the cocking arm 22, actuation of the magazine escapement mechanism occurs only at the end of the cocking stroke. The gun actually becomes fully cocked slightly prior to that. This means that an operator would ordinarily know, from the feel of the action, that the gun was already cocked before further indexing of the magazine was caused. In this way, the accidental loading of two pellets from the magazine into the breech should not arise.

The plunger 60 is depressible against the action of a spring (not shown). The spring is sufficiently strong for the pawl-returning spring 58 to be overcome, but permits over-travel of the cocking arm 22 after the pawl has become fully depressed by the plunger. As compared with use of a solid plunger, this enables slightly earlier operation of the escapement mechanism and provides for actuation of the mechanism to be effected even if the cocking arm is not taken quite fully to the end of its available stroke.

Whilst in the arrangement described and illustrated the pawl 50 engages in slits 40 in the drum 33 of the magazine, it will be appreciated that mechanically equivalent alternatives (e.g. pegs or teeth projecting from the drum) could be employed to the same ends.

Also, the actuation of the escapement mechanism by means of the plunger 60 on the cocking arm 22 could be replaced by other means. In particular, a solenoid-operated plunger may be provided which is actuated upon electrical contacts being closed by movement of the cocking arm or other components associated with the cocking action.

Provision is made for preventing a pellet in the slot S, at the breech-loading position of the magazine, from falling out of the magazine (through either aperture 42) when the loaded magazine is not in the gun. For this purpose, the pawl 50 of the escapement mechanism is arranged to arrest the drum 33, driven rotationally by the drive spring 42, in a position slightly beyond exact alignment with the apertures 64 in .the housing 31 and rear cover plate 30. Such misalignment is illustrated, somewhat exaggerated, in FIG. 4. By this means, rearwards movement of a pellet out of the drum slot S is prevented by that portion of the rear cover plate 30 overlapping the slot and acting as a stop to the rear end of the pellet.

At the front end of the magazine the corresponding misalignment between the slot S and the aperture 64 in the housing 31 may not be sufficient to prevent a substantial length of pellet from projecting through the aperture, depending upon the form of the pellet. To retain the pellets, therefore, two O rings 66 of a resilient rubbery material are located in circumferentially-extending grooves in the outer surface 41 of the drum 33, the grooves being sufficiently deep for the rings 66 to intrude into the pellet-holding slots 38. The rings intrude sufficiently to serve as resilient stops within the slots 38, ordinarily limiting forwards movement of the pellets but permitting the pellets to be pushed past by the loading ram 28 when required for loading into the breech.

Upon advance of the loading ram 28 in operation of the gun, the ram in entering the slot S through the rear aperture 64 displaces the drum 33 rotationally backwards against the drive spring 42, so bringing the slot S into precise axial alignment with the apertures 64 and the barrel bore, for insertion of the pellet into the breech.

What is claimed is:

1. An air gun comprising an exchangeable magazine arranged to hold a plurality of pellets for loading one at a time into a breech of the gun, the magazine comprising:

(a) a carrier located in the gun adjacent to the breech;

(b) a drum which is rotatably mounted on the carrier and presents a plurality of pellet-holding slots distributed around its rotational axis;

(c) a drive spring acting between the drum and the carrier to rotate the drum to bring the slots successively into alignment with the breech for insertion of pellets into the breech; and (d) an escapement mechanism acting between the drum and the carrier to arrest rotation of the drum by the drive spring and operable intermittently to release the drum for rotation in indexing steps; and the gun comprising also:

(i) a reciprocable loading ram adapted to be driven longitudinally into an aligned one of said slots in the drum to drive a pellet from the drum and into the breech;

(ii) escapement-actuating means; and (iii) cocking mechanism operable in a cocking action to cock the gun for firing and being operatively associated with said loading ram for causing reciprocating of the ram and being operatively associated with said escapement-actuating means for causing operation of said escapement mechanism subsequently in the cocking action to withdrawal of the loading ram from the drum.

2. An air gun according to claim 1 in which in operation of the cocking mechanism the gun becomes fully cocked not later than the stage at which the escapement mechanism becomes actuated.

3. An air gun according to claim 1 in which actuation of the escapement mechanism from the clocking mechanism is by means of an operating plunger which projects from a pivotable cocking arm of the cocking mechanism.

4. An air gun according to claim 1 in which actuation of the escapement mechanism from the cocking mechanism is by means of electrical contacts which become closed by a pivotable cocking arm of the cocking mechanism to cause operation of a solenoid-operated device.

5. An air gun according to claim 1 in which the escapement mechanism comprises a rocking pawl which in each complete oscillation permits rotation of the drum by one indexing step.

6. An air gun according to claim 5 in which the pawl is spring-biased in one direction of pivotal movement and arranged to be deflected against the action of the spring by the escapement-actuating means.

* * * * *